US006314268B1

(12) United States Patent
Giunta et al.

(10) Patent No.: US 6,314,268 B1
(45) Date of Patent: Nov. 6, 2001

(54) TRI-ROLL DECURLER

(75) Inventors: Kenneth E. Giunta, Penfield; Arthur H. Kahn, Cohocton; Daniel H. Burnett; Anthony G. Poletto, both of Fairport, all of NY (US)

(73) Assignee: Xerox Corporation, Rochester, NY (US)

( * ) Notice: Subject to any disclaimer, the term of this patent is extended or adjusted under 35 U.S.C. 154(b) by 0 days.

(21) Appl. No.: 09/679,215

(22) Filed: Oct. 5, 2000

(51) Int. Cl.[7] ..... G03G 15/00
(52) U.S. Cl. ..... 399/406
(58) Field of Search ..... 399/401, 406; 162/197, 270, 271; 271/161, 188, 209, 212

(56) References Cited

U.S. PATENT DOCUMENTS

| | | | |
|---|---|---|---|
| 4,326,915 | 4/1982 | Mutschler, Jr. | 162/271 |
| 4,571,054 | 2/1986 | Bowler, Jr. | 399/323 |
| 4,591,259 | 5/1986 | Kuo et al. | 399/406 |
| 4,627,718 | 12/1986 | Wyer | 399/406 |
| 5,144,385 * | 9/1992 | Tani | 399/406 |
| 5,270,778 | 12/1993 | Wyer | 399/406 |
| 5,548,389 | 8/1996 | Bowler, Jr. | 399/406 |
| 5,572,308 * | 11/1996 | Suda et al. | 399/406 X |
| 5,749,040 * | 5/1998 | Muramatsu | 399/406 |
| 5,787,331 * | 7/1998 | Ohkuma et al. | 399/406 |

* cited by examiner

*Primary Examiner*—Arthur T. Grimley
*Assistant Examiner*—Hoan Tran
(74) *Attorney, Agent, or Firm*—Perman & Green, LLP

(57) ABSTRACT

A tri-roll sheet curl control apparatus is described which includes an elastomer first roll forming a first nip with a second roll, the first roll having a compressible surface. The apparatus includes an elastomer third roll having a compressible surface which forms a second nip with the second roll surface. The second roll surface is formed of a material having a substantially noncompressible surface. The apparatus further includes a pivotable gate member that is in operating relationship with the first, second and third rolls so as to direct a sheet to either the first or the second nip so that the desired decurling orientation is achieved for the sheet by either the elastomer first roll or the elastomer third roll.

11 Claims, 2 Drawing Sheets

TRI-ROLL DECURLER

BACKGROUND OF THE INVENTION

1. Field of the Invention

This invention relates to a decurling apparatus for decurling sheets of paper, and more particularly this invention relates to an apparatus for reducing sheet curl as induced, for example, by heat and pressure roll type fusers of the type typically employed in a xerographic or electrophotographic or analogous-type printing machines.

2. Description of the Prior Art

In the art of xerography, a photoconductor P/C generally comprising a photoconductive insulating material adhered to a conductive backing is charged uniformly. Then the P/C is exposed to a light image of an original document to be reproduced. The latent electrostatic images, thus formed, are rendered visible by applying any one of numerous pigmented resins specifically designed for this purpose. In the case of a reusable P/C, the pigmented resin, more commonly referred to as toner which forms the visible images is transferred to plain paper. After transfer, the toner images are made to adhere to the copy medium usually through the application of heat and pressure by means of a roll fuser.

One of the advances in the art of contact fusing of toner images is the nip forming roll fuser (i.e. a roll fuser wherein the nip between the rolls is formed by deforming the softer fuser roll) wherein a heated roll is provided with an outer deformable coating of silicon rubber, for example. A harder, usually non-heated, pressure roll is pressure engaged with the softer fuser roll to create a nip therebetween. Copy sheets having toner images electrostatically adhered thereto are passed through the nip with the images contacting the heated roll.

The requisite roll size is a function of a number of variables such as the copy making speed of the machine. Thus, the faster machines utilize relatively larger rolls whereas the slower machines use small (i.e. 1½ to 2 inch diameter) diameter rolls. With the smaller rolls, the copy sheets release or fall away from the nip forming fuser roll thereby coming to rest on the pressure roll mounted beneath the fuser roll. This results in the copy sheet taking the general shape of the pressure roll. One such fuser arrangement was found to produce between ½ to 1½ inch flat curl which bends away from the image. The copies in some cases form scrolls and can cause post fuser handling problems, in particular, with regard to the stacking of the copies in the output tray.

In addition to the fusing operation, as the sheet of support material passes through the various processing stations in, for example, an electrophotographic printing machine, a curl or bend is frequently induced therein. Occasionally, this curl or bend may be inherent in the sheet of support material due to the method of manufacture thereof. It has been found that this curl is variable from sheet to sheet within the stack of sheets utilized in the printing machine. The curling of the sheet of support material causes handling issues as the sheet is processed in the printing machine. Sheets delivered in a curled condition have a tendency to have their edges out of registration with the aligning mechanisms employed in the printing machine. In addition, curled sheets tend to frequently produce jams or misfeeds within the printing machine. This problem has been resolved by utilizing bars, rollers or cylinders which engage the sheet material as it passes through the printing machine. Frequently, belts or soft rollers are used in conjunction with a hard penetrating roll to remove the curl in a sheet. However, systems of this type have disadvantages. For example, the size of the de-curler is not necessarily consistent with that required in electrophotographic printing machines. In addition, decurlers of this type cannot decurl under stress conditions since they do not strain the sheets due to belt flexing.

Various approaches have been devised to improve sheet de-curlers such as described in the following prior art references:

U.S. Pat. No. 4,326,915
Patentee: Mutschler
Issued: Apr. 27, 1982
U.S. Pat. No. 4,571,054
Patentee: Bowler, Jr.
Issued: Feb. 18, 1986
U.S. Pat. No. 4,591,259
Patentee: Kuo, et al.
Issued: May 27, 1986
U.S. Pat. No. 4,627,718
Patentee: Wyer
Issued: Dec. 9, 1986
U.S. Pat. No. 5,237,381
Patentee: Hamada
Issued: Aug. 17, 1993
U.S. Pat. No. 5,270,778
Patentee: Wyer
Issued: Dec. 14, 1993
U.S. Pat. No. 5,548,389
Patentee: Bowler, Jr.
Issued: Aug. 20, 1996
U.S. Pat. No. 5,848,347
Patentee: Kuo, et al.
Issued: Dec. 8, 1998

The disclosures of the foregoing prior art patents can be briefly summarized as follows:

Mutschler (U.S. Pat. No. 4,326,915) describes an apparatus in which sheet material is decurled. The apparatus presses the sheet material into contact with a substantially rigid arcuate member in at least two regions. In this way, the sheet material moves about the arcuate member in a curved path to remove the curl therein.

Bowler, Jr. (U.S. Pat. No. 4,571,054) describes a post-fuser copy sheet decurler including means for reverse (i.e. direction opposite to bending caused by the pressure roll) bending of the copy sheets while they are in a plastic state, that is while the sheets are still at an elevated temperature.

Kuo, et al. (U.S. Pat. No. 4,591,259) describes an apparatus in which sheet material is decurled. The apparatus includes a baffle type decurler in which a sheet moving therethrough chooses one of three paths and baffles, depending on the direction and amount of curl. Spring loaded baffles in conjunction with idler rolls reverse bends the sheets in two of the three paths.

Wyer (U.S. Pat. No. 4,627,718) describes a sheet curl control apparatus that includes a pair of contacting rolls and a baffle extending across the path of a sheet exiting the nip between the rolls so as to deflect it about one of the rolls.

Hamada (U.S. Pat. No. 5,237,381) describes a sheet curl discharging apparatus having a curl generating device wherein a curl is generated in a sheet while the sheet is passing through the curl generating device, and a first guide disposed downstream of the curl generating device and switchingly movable between a first position where the sheet is directed toward a curved sheet path and a second position where the sheet is directed toward a direction the same as sheet feeding direction from the curl generating device. The apparatus further has a sheet discharge guide disposed between the curl generating device and the first guide and switchingly movable in synchronism with the switching movement of the first guide to change its posture, between a position where the sheet discharged from the curl generating device is curled reversely and a position where the sheet discharged from the curl generating device is not further curled.

Wyer (U.S. Pat. No. 5,270,778) describes a sheet curl control apparatus including a decurler for reducing the curl in sheet material passing therethrough and adjusting means coupled to the decurler for adjusting the decurling action of the decurler. Sensing means in the form of an infra-red emitter and two infra-red detectors are employed for sensing the extent of any residual curl left in the sheet material after it has passed through the decurler and for feeding a signal indicative of the residual curl to control means, conveniently including a stepper motor, for automatically adjusting the adjusting means, for example a rack and pinion arrangement, thereby to alter the decurling action of the decurler in a predetermined manner. The sheet curl control apparatus is described in relation to its use in a copier for duplex copying.

Bowler, Jr. (U.S. Pat. No. 5,548,389) describes a copy sheet decurling mechanism employed in conjunction with a heat and pressure fuser for reducing or eliminating the curl induced into the copy sheets by the fuser roll of the fuser. Stripper fingers, the position and/or angle of which can be selectively varied, are provided for reverse (i.e. direction opposite to bending caused by the pressure roll) bending of the copy sheets while they are in a plastic state, that is while the sheets are still at an elevated temperature.

Kuo, et al. (U.S. Pat. No. 5,848,347) describes a compact dual decurler mechanism that provides a single straight paper path for achieving bidirectional decurling capability consisting of two pairs of drive roll and pinch shaft and a camming mechanism for controlling their engagements. The first and second pairs are oriented in opposite directions. A first elastomer drive roll is disclosed.

In view of the current state of the prior art technology there exists a need to have an improved decurler, especially a decurler for use in a xerographic or electrophotographic printer that is able to decurl in the direction towards the image on the sheet as well as decurling in the direction away from the image on the sheet. Previously, this has been accomplished by using two separate decurlers, one for each curl direction. In addition, instead of the need for an expensive support structure for a decurler apparatus, there exist a need for a simple and relatively inexpensive decurler apparatus. In addition to these and all the other advantages of a decurler apparatus as referred to above, it would represent a very large advantage if the user of a xerographic or electrophotographic printer having a decurler apparatus as part of its finishing process could easily adjust the amount of decurling in the paper sheets. Accordingly, it is a primary advantage of this invention to provide a new and improved decurler apparatus for use in a printing machine such as a xerographic or electrophotographic printer which will exhibit all of the specific advantages referred to above.

Additional advantages of the invention will be set forth in part in the description which follows, and some will be obvious from the description, or may be learned by practice of the invention in accordance with various features and combinations as particularly pointed out in the appended claims.

SUMMARY OF THE INVENTION

All of the foregoing advantages and others in accordance with the features of the present invention are attained by a tri-roll sheet curl control apparatus comprising: an elastomer coated first roll forming a first nip with a second roll, the first roll having a compressible surface; an elastomer third roll having a compressible surface and forming a second nip with the second roll surface, the second roll surface formed of a material having a substantially non-compressible surface; and a pivotable gate member in operating relationship with the first, second and third rolls to direct the sheet to either the first or said the second nip whereby the desired decurling orientation is achieved for the sheet by either the elastomer first roll or the elastomer third roll.

In accordance with the various embodiments of the present invention, the elastomer first roll is adapted to perform as a structural member primarily preventing deflection of the non-compressible second roll thereby assisting in keeping the second roll in its proper orientation, and the elastomer third roll is adapted to perform as the decurler roll for the sheet. Furthermore, the elastomer third roll is also adapted to perform as a structural member primarily preventing deflection of the noncompressible second roll thereby assisting in keeping the second roll in its proper orientation, while the elastomer first roll is adapted to perform as the decurler roll for the sheet.

BRIEF DESCRIPTION OF THE DRAWINGS

The accompanying drawings which are incorporated in and constitute a part of the specification illustrate one embodiment of the invention and, together with the following detailed description, serve to explain the principles of the present invention.

DESCRIPTION OF THE PREFERRED EMBODIMENT

Figure 1:
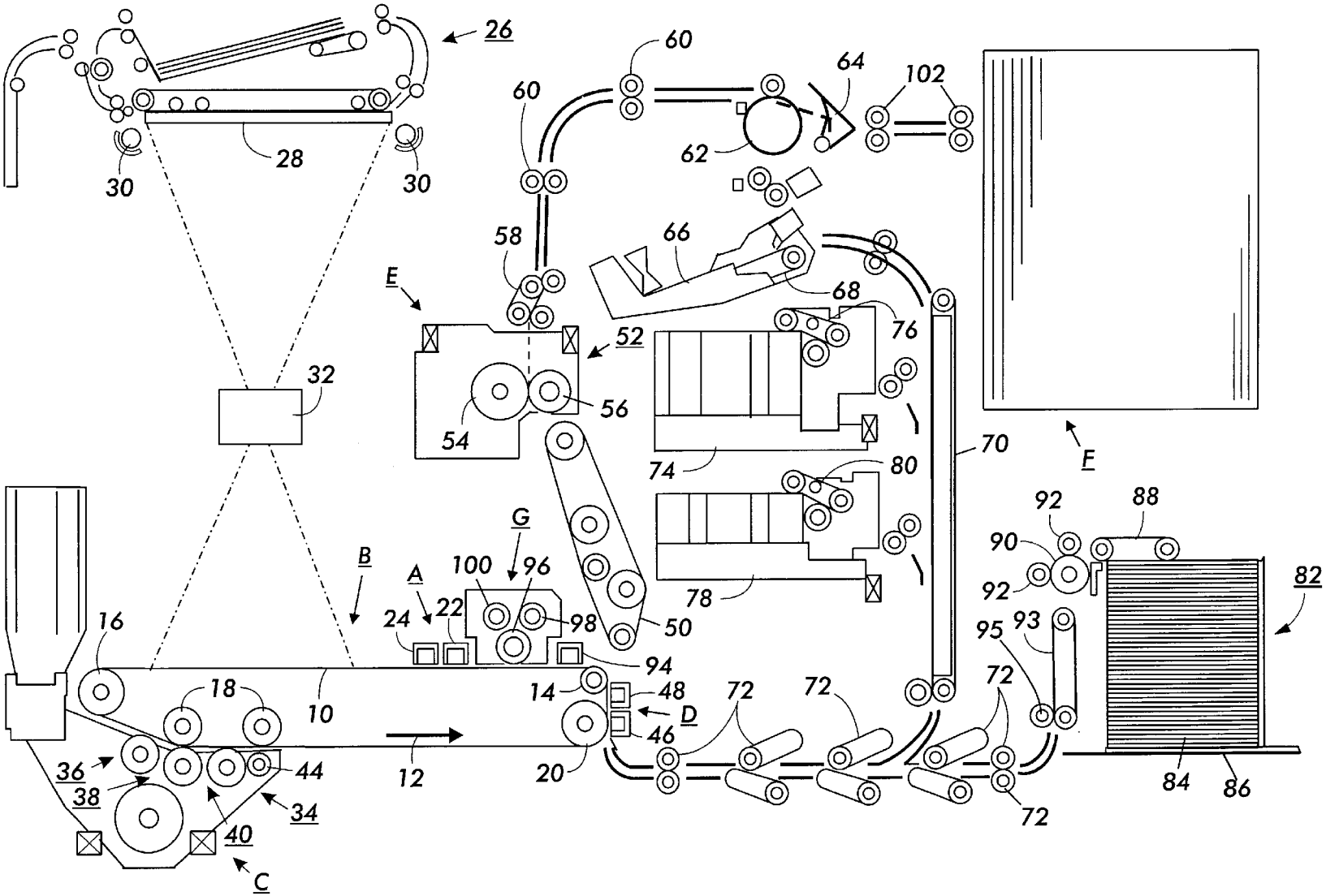
FIG. 1 is a schematic elevational view depicting an illustrative electrophotographic printing machine incorporating the sheet de-curling apparatus having the features as described by the present invention.

While the present invention will hereinafter be described in connection with a preferred embodiment thereof, it will be understood that it is not intended to limit the invention to that embodiment. On the contrary, it is intended to cover all alternatives, modifications, and equivalents, as may be included within the spirit and scope of the invention as defined by the appended claims.

For a general understanding of the features of the present invention, reference is made to the drawings. In the drawings, like reference numerals have been used throughout to identify identical elements.

FIG. 1 schematically depicts an electrophotographic printing machine incorporating the tri-roll sheet curl control apparatus of the present invention therein. It will become evident from the following discussion that the decurler apparatus of the present invention may be employed in a wide variety of devices and is not specifically limited in its application to the particular embodiment depicted herein which is given solely to illustrate an example of where the decurler apparatus having the features of the present invention can be used.

Referring to FIG. 1 of the drawings, the electrophotographic printing machine employs a photoconductive belt 10. Preferably, the photoconductive belt 10 is made from a photoconductive material coated on a grounding layer, which, in turn, is coated on an anti-curl backing layer. The photoconductive material is made from a transport layer coated on a generator layer. The transport layer transports positive charges from the generator layer. The interface layer is coated on the grounding layer. The transport layer contains small molecules of di-m-tolydiphenylbiphenyldiamine dispersed in a polycarbonate. The generation layer is made from trigonal selenium. The grounding layer is made from a titanium coated MYLAR. The grounding layer is very thin and allows light to pass therethrough. In accordance with the features of the present invention other suitable photoconductive materials, grounding layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, idler rollers 18, and drive roller 20. Stripping roller 14 and idler rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of the photoconductive surfaces passes through the charging station A. At charging station A, two corona generating devices, indicating generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder located below the tray forwards the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses light images of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36, 38, and 40. A paddle wheel 42 picks up developer material and delivers it to the developer rolls. When developer material reaches rolls 36 and 38, it is magnetically split between the rolls with half of the developer material being delivered to each roll. Photoconductor belt 10 is partially wrapped about rolls 36 and 38 to form extended development zones. Developer roll 40 is a cleanup roll. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. First, photoconductive belt 10 is exposed to a pre-transfer light from a lamp (not shown) to reduce the attraction between photoconductive belt 10 and the toner powder image. Next, a corona generating device 46 charges the copy sheet to the proper magnitude and polarity so that the copy sheet is tacked to photoconductive belt 10 and the toner powder image attracted from the photoconductive belt to the copy sheet. After transfer, corona generator 48 charges the copy sheet to the opposite polarity to detach the copy sheet from belt 10. Conveyer 50 advances the copy sheet to fusing station E.

Fusing station E includes a fuser assembly, indicated generally by the reference numeral 52 which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent transfers to a donor roll and then to the fuser roll.

After fusing, the copy sheets are fed through a decurler 58. Decurler 58 bends the copy sheet in such a way that the sheet curl is substantially reduced. The details of decurler apparatus 58 in accordance with the features of the present invention will be described in detail hereinafter with reference to FIG. 2.

Forwarding rollers 60 then advance the sheet to duplex turn roll 62. Duplex solenoid gate 64 guides the sheet to the finishing station F or to duplex tray 66. Duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70 and rollers 72 for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. The secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the tray to transfer station D. A vacuum feed belt 88 feeds successive uppermost sheets from the stack to a take away drive roll 90 and idler rolls 92. The drive roll and idler rolls guide the sheet onto transport 93. Transport 93 and idler roll 95 advance the sheet to rolls 72 which, in turn, move the sheet to transfer station station D.

Invariably, after the copy sheet is separated from the photoconductive surface of belt 10, some residual particles remain adhering thereto. After transfer, photoconductive belt 10 passes beneath corona generating device 94 which charges the residual toner particles to the proper polarity. Thereafter, a precharge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaning brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Figure 2:
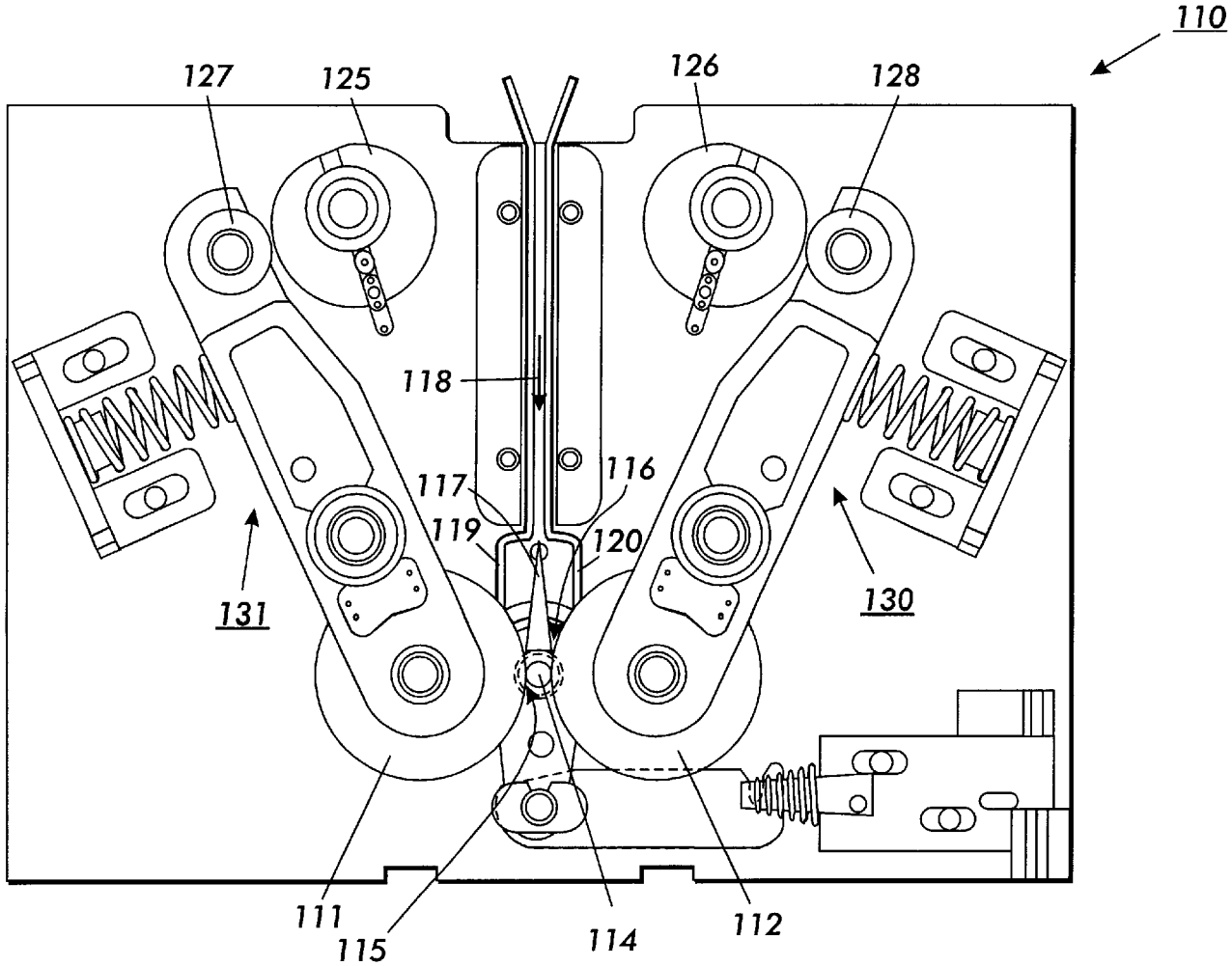
FIG. 2 is an elevational view illustrating an embodiment of the tri-roll de-curling apparatus in accordance with the features of the present invention which can be used in the electrophotographic printing machine illustrated in FIG. 1.

Referring now to a description of one embodiment of the present invention there is shown a in FIG. 2 a de-curling apparatus 110 in greater detail. De-curling apparatus 110 removes the curls in a sheet of support material such as a sheet of paper that has been, for example, subject to an imaging process by the electrophotographic printer illustrated in FIG. 1, e.g. due to the fuser operation in Fusing Station E. Curling can also occur by straining the sheet about a small diameter during the printing process. The de-curling apparatus 110 in accordance with the features of the present invention is compact permitting space constraints to be optimized.

The apparatus 110 comprises a three roll structure including first and third soft elastomer rolls 111 and 112. These rolls 111 and 112 are preferably constructed of an elastomeric material having a compressible outer surface such as any of the well known silicone based elastomer materials. The particularly elastomer material that is chosen for the outer surface of soft rolls 111 and 112 in accordance with the features of the present invention depends to a large extent on the desired or required degree of compression. In any event, the same elastomer material is employed as the outer compressible surface of both rolls 111 and 112. Rolls 111 and 112 ride on a hard drive roll 114 whose outer surface is formed of a hard, non-compressible material such as a metallic material. The outer surface of hard roll 114 can be formed of numerous metallic materials to achieve the desired hard, non-compressible outer surface. For example, a tool steel material can be used or the outer surface material for roll 114. Each of the soft compressible rolls 111 and 112 form a nip with hard, non-compressible, roll 114. Soft compressible roll 111 forms a nip 115 with hard, non-compressible roll 114, and soft compressible roll 112 forms a nip 116 with hard, non-compressible roll 114. The tri-roll decurler 110 in accordance with the features of the present invention therefore includes a hard (non-compressible) drive roll 114 between two soft (compressible) elastomer rolls 111 and 112. A unique and critical feature of the present invention is that the backer systems or structural support systems of decurler 110 are the elastomer rolls 111 and 112 of the decurler 110 itself, i.e. the decurler 110 as defined by the present invention uses one of the elastomer (soft compressible) rolls 111 or 112 to function as a structural member while at the same time using the other elastomer (soft compressible) roll 111 or 112 as the de-curler roll. In operation the elastomer roll 111 or 112 which is being used to function as a structural member presses against the hard roll 114. Since the elastomer rolls 111 or 112 have a compressible surface, and the hard drive roll 114 has a non-compressible surface any tendency for the hard drive roll 114 to deflect will be prevented by the absorption of the compressive forces from the hard drive roll 114 to either of the soft/compressible elastomer rolls 111 or 112. De-curling apparatus 110 includes a pivotable sheet guide or pivotable gate indicated generally by reference number 117. As the sheet of support material (e.g. paper) advances in the direction of arrow 118 it passes between sheet metal guides 119 and 120. The full length pivotable gate 117 pivots to direct the sheets to obtain the desired de-curling orientation, i.e.(i) directs the sheet to nip 115 in which case elastomer roll 111 will together with hard roll 114 perform the de-curling operation. As roll 111 is the decurling roll, the elastomer third roll 112 will function as a structural member absorbing the compressive forces of hard second roll 114 to prevent deflection of the hard roll; or (ii) directs the sheet to nip 116 in which case the elastomer third roll 112 will together with hard second roll 114 perform the de-curling operation while the elastomer first roll 111 will function as a structural member absorbing the compressive forces of hard roll 114 to prevent deflection of the hard roll.

The full length gate 117 pivots to direct the sheet such that AI (i.e. away from the image on the sheet) or TI (i.e. toward the image on the sheet) decurling is achieved. The function of the gate 117 is to direct the paper sheet from, for example, a fuser operation to the top two rolls or the bottom two rolls of decurler 110 depending on the curl itself after fusing. The controller for pivoting the gate is basically a simple pivoting device driven by a solenoid.

In the embodiment of a de-curler apparatus 110 as illustrated in FIG. 2, the hard drive roll 114 does not translate to form either the de-curling nips 115 or 116, but the compressible elastomer decurler rolls 111 or 112 are cammed independently by driving cams 125 and 126 which, as illustrated, drive cam followers 127 and 128 respectively. A rocker arm and spring mechanism 130 and 131 place a compressive force on each of cam followers 127 and 128.

The invention for a de-curler apparatus as described herein also provides for a system that is totally in linear loading i.e., a linear loaded mechanism to minimize any deflection. The design for a linear actuating mechanism consists of two cam shafts driven by a stepper motor that when turned will move the elastomer rolls toward a central 6 mm diameter steel roll. End blocks can be used to hold bearings for the drive shaft, elastomer rolls and cam shaft. A gate is also supported on the drive shaft to direct the sheet into either of the nips.

Roll 114 is driven by a servomotor instead of the more typical stepper motor. Another feature that is an advantage of de-curler 110 is that the curl on the sheet can be adjusted on the fly using the user interface of the machine that incorporates the decurler apparatus of this invention, i.e., the user of the machine can adjust the degree of decurl depending on variables such as, for example, the type of paper used, the humidity, etc.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A tri-roll sheet curl control apparatus comprising:

an elastomer first roll forming a first nip with a second roll, the first roll having a compressible surface;

an elastomer third roll having a compressible surface and forming a second nip with the second roll surface; the second roll surface formed of a material having a substantially noncompressible surface; and a pivotable gate member in operating relationship with the first, second and third rolls to direct the sheet to either the first or the second nip whereby the desired decurling orientation is achieved for the sheet by either the elastomer first roll or the elastomer third roll wherein both the elastomer first roll and the elastomer third roll are adapted to perform as structural members primarily preventing deflection of the non-compressible second roll thereby assisting in keeping the second roll in its proper orientation.

2. An apparatus according to claim 1 wherein said elastomer third roll is adapted to perform as the decurler roll for said sheet.

3. An apparatus according to claim 1 wherein said elastomer first roll is adapted to perform as the decurler roll for said sheet.

4. An apparatus according to claim 1 wherein said elastomer first roll and said elastomer third roll are each independently engaged by a cam.

5. An apparatus according to claim 1 wherein the forces on each of the first, second and third rolls in relationship to one another are linear loaded by a linear actuating mechanism whereby deflection of said hard roll is minimized.

6. An apparatus according to claim 1 further including means to adjust the amount of curl in said sheet.

7. An apparatus according to claim 5 wherein said linear actuating mechanism comprises two cam shafts driven by a stepper motor adapted to force said elastomer first and third rolls towards said non-compressible second roll.

8. An apparatus according to claim 7 wherein said gate is driven by a solenoid.

9. An apparatus according to claim 1 wherein said sheet is received from a fusing process of a xerographic printer.

10. An apparatus according to claim 1 wherein the outer surface of both said first and said third elastomer rolls are formed of the same elastomer material.

11. An apparatus according to claim 10 wherein said elastomer material is a silicone or urethane based elastomer material.

* * * * *